US007810410B2

(12) United States Patent
Kim et al.

(10) Patent No.: US 7,810,410 B2
(45) Date of Patent: Oct. 12, 2010

(54) DRUM AND WASHING MACHINE OR DRYER USING THE SAME

(75) Inventors: Jin Woong Kim, Seoul (KR); Na Eun Kim, Seoul (KR); Young Hwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 743 days.

(21) Appl. No.: 11/693,466

(22) Filed: Mar. 29, 2007

(65) Prior Publication Data

US 2007/0261513 A1 Nov. 15, 2007

(30) Foreign Application Priority Data

Mar. 29, 2006 (KR) ..... 10-2006-0028357

(51) Int. Cl.
*F16F 15/32* (2006.01)

(52) U.S. Cl. ..... 74/572.4

(58) Field of Classification Search ..... 74/572.4; 68/12.06, 23.2, 142

See application file for complete search history.

(56) References Cited

U.S. PATENT DOCUMENTS 5,280,660 A 1/1994 Pellerin
5,746,070 A 5/1998 Bailey
7,287,402 B2 * 10/2007 Ratfisch ..... 68/142
2003/0046962 A1 3/2003 Sonoda

FOREIGN PATENT DOCUMENTS

| | | | |
|---|---|---|---|
| CN | 2305421 Y | | 1/1999 |
| DE | 3743657 A1 | * | 7/1989 |
| EP | 475848 A1 | * | 3/1992 |
| EP | 1 295 978 | | 3/2003 |
| JP | 2003-93787 | | 4/2003 |
| JP | 2003230791 A | * | 8/2003 |
| JP | 2004248732 A | | 9/2004 |

OTHER PUBLICATIONS

Chinese Office Action dated Feb. 6, 2009 for Application No. 200710089052.0 (with full English language), 7 pages.
European Search Report dated Aug. 21, 2007, issued on European Application No. 07006294.8; (7 pages).
Chinese Patent Gazette dated Dec. 2, 2009 for Application No. 200710089052.0, 1, non-English language, 16 pages.

* cited by examiner

*Primary Examiner*—Vicky A Johnson
(74) *Attorney, Agent, or Firm*—Fish & Richardson P.C.

(57) ABSTRACT

The present invention relates to a drum rotatable provided in a washing machine or a dryer to dry laundry. A drum for a washing machine or a dryer includes an operable drum door provided at a circumferential surface of the drum; a balance weight provided at the circumferential surface of the drum. The balance weight is placed opposite to the operable drum door to balance the drum.

13 Claims, 3 Drawing Sheets

DRUM AND WASHING MACHINE OR DRYER USING THE SAME

CROSS REFERENCE TO RELATED APPLICATION

This application claims the benefit of the Korean Patent Application No. 10-2006-0028357, filed on Mar. 29, 2006, which is hereby incorporated by reference as if fully set forth herein.

BACKGROUND OF THE DISCLOSURE

1. Field of the Disclosure

The present invention relates to a drum that is rotatable within a washing machine or a dryer to dry laundry.

2. Discussion of the Related Art

Rotatable drums are provided in washing machines or dryers and laundries are introduced in the drums. An opening for an access to a drum is typically formed at an end of a cylindrical drum in a longitudinal direction. Alternatively, the opening may be formed in an outer circumferential surface of the drum. When the opening is formed in the outer circumferential surface of the drum, a drum door is coupled to the outer circumferential surface of the drum. However, the drum door coupled to the outer circumferential surface of the drum might cause unbalance of the drum as well as vibration and noise during rotation of the drum.

SUMMARY OF THE DISCLOSURE

Accordingly, the present invention is directed to a drum and a washing machine or dryer using the same.

An advantage of the present invention is to provide a drum that keeps balance of the drum.

Another advantage of the present invention is to provide a drum to which a balance weight is secured solidly.

A further advantage of the present invention is to provide a drum with a simple structure, which includes a balance weight.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum for a washing machine or a dryer, the drum includes an operable drum door provided at a circumferential surface of the drum; a balance weight provided at the circumferential surface of the drum. The balance weight is placed opposite to the operable drum door to balance the drum.

The balance weight may include a first end secured to a first rim of the drum; and a second end opposite to the first end, wherein the second end is secured to a second rim of the drum which is opposite to the first rim of the drum. The balance weight may further include a middle portion secured to the circumferential surface of the drum.

The balance weight may be arranged on an inner circumferential surface of the drum, so that the balance weight lifts and drops laundry placed in the drum during a rotation of the drum.

The drum may further include a plurality of lifters provided on an inner circumferential surface of the drum to lift and drop laundry placed in the drum during rotation of the drum. The balance weight may have an appearance substantially identical to the plurality of the lifters.

The balance weight may include a cover arranged along a longitudinal direction of the drum. The balance weight may further include at least one weight provided in the cover. The cover may include at least one extension extended from the cover to at least one weight to prevent at least one weight from playing.

The balance weight may further include a base interposed between at least one weight and the drum to securely support at least one weight. The base may include a curved bottom surface that contacts with an inner surface of the drum.

The base may include a plurality of projections projected from a surface of the base along a longitudinal direction of the base to reinforce the strength of the base. The base may include side walls upwardly extended from a top or sides of the base to accommodate at least one weight therein. The base may include a recess provided on a top of the base to accommodate at least one weight therein.

The cover may include at least one protrusion protruded from the cover to prevent the base from playing.

In another aspect, a washing machine or dryer includes a drum including an operable drum door provided at a circumferential surface thereof; and a balance weight provided at the circumferential surface of the drum to balance the drum during rotation of the drum. The balance weight is secured to both rims of the drum.

The washing machine or dryer may further include a lifter projected from an inner circumferential surface of the drum to lift and drop laundry placed in the drum during the rotation of the drum. The balance weight may be placed opposite to the operable drum door.

The balance weight may include a cover that has an appearance substantially identical to the lifter. The cover lifts and drops the laundry during the rotation of the drum.

The balance weight may further include at least one weight provided within the cover. The cover comprises at least one extension extended from the cover to at least one weight to prevent at least one weight from playing.

The balance weight may further include a base interposed between at least one weight and the drum to securely support at least one weight. The base may include side walls that accommodate at least one weight therein. The cover may include at least one protrusion protruded from the cover to prevent the base from playing.

In a further aspect, a balance weight of a drum for a washing machine or a dryer includes a base mounted on an inner circumferential surface of the drum; at least one weights placed on the base; and a cover that covers the base and at least one weight. The cover is projected from the inner circumferential surface of the drum to lift and drop laundry placed in the drum during rotation of the drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

A drum of the present invention may be used in a home appliance for washing or drying laundry, for example, a washing machine or a dryer. The other components of the washing machine or dryer except the drum are substantially similar or the same as conventional washing machines or dryers. Thus, a structure of the drum according to the present invention will be explained as follows.

Figure 1:
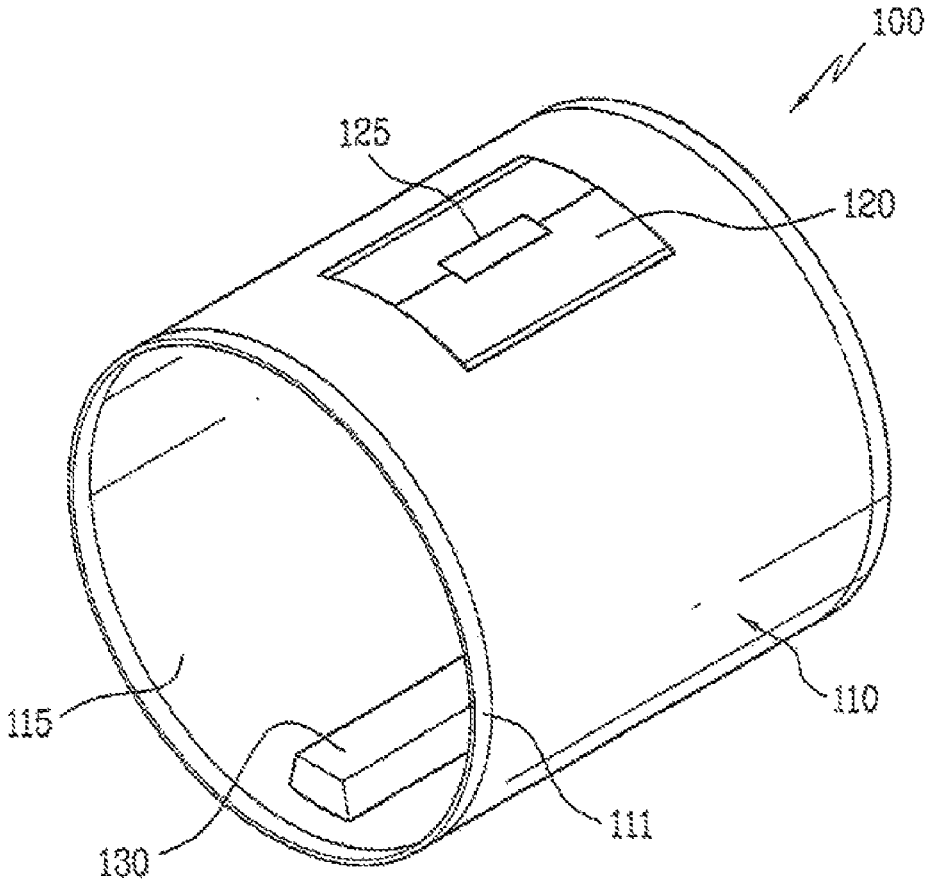
FIG. 1 is a perspective view illustrating a drum according to a first embodiment.
Figure 2:
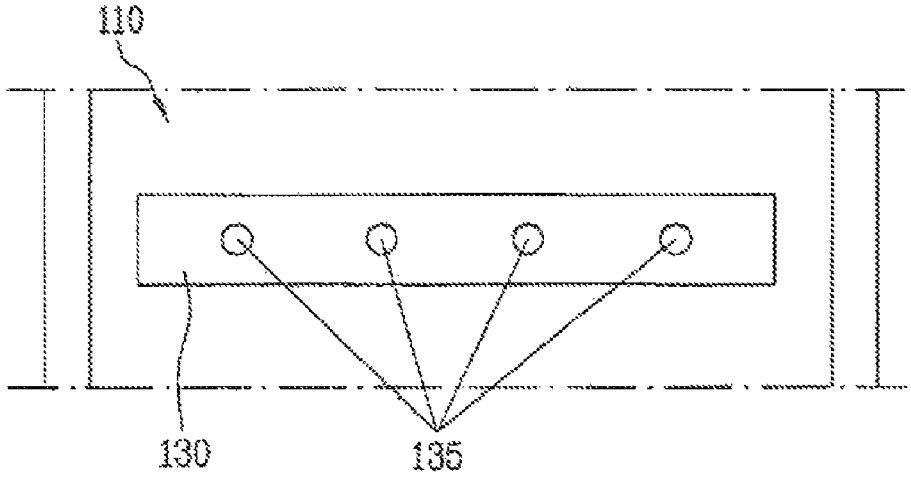
FIG. 2 is plane view schematically illustrating that a balance weight shown in FIG. 1 is secured to the drum.

FIG. 1 illustrates a first embodiment and FIG. 2 illustrates that a balance weight shown in FIG. 1 is secured to the drum. As shown in FIG. 1, the drum 100 has a cylindrical shape and both longitudinal ends of the drum are closed. A circumferential surface 110 of the drum 100 is formed of a rectangular plate rolled in a cylindrical shape. The both end surfaces of the drum 100 are fabricated of circular plates and they are fixed to the circumferential surface 110 of the drum 100, respectively. Also, as shown in FIGS. 1 and 2, rims 111 are formed at both ends of the circumferential surface 110 and the rims 111 reinforce strength of the portions where the circular end surfaces of the drum 100 are secured to the ends of circumferential surface 110 of the drum 100.

An opening is provided in the circumferential surface 110 of the drum 100, which gives a user an access to an inside of the drum 100. An operable drum door 120 is provided at the circumferential surface 110 of the drum 100 to close the opening. The operable drum door 120 is coupled to the drum 100 by a hinge. The operable drum door 120 is locked by a latch 125, with the opening closed, when the drum 100 rotates. One operable drum door 120 may be provided and a pair of the operable drum door 120 may be provided as shown in FIG. 1.

A balance weight 130 is provided on the circumferential surface 110 of the drum 100 and the balance weight 130 keeps balance of the drum 100. The balance weight 130 may be placed opposite to the operable drum door 120. Owing to the balance weight 130, it is prevented that the gravity center of the drum 120 is off the rotation center of the drum 120 and, as a result, balance of the drum 100 may be kept during the rotation of the drum 100.

The balance weight 130 may be provided on an inner circumferential surface 115 of the drum 120, for example. As shown in FIG. 2, the balance weight 130 is positioned on the inner circumferential surface 115 of the drum 100 and it is fixed by a plurality of securing members 135. However, this structure may have a disadvantage that a reinforcement member is additionally provided at some portion of the circumferential surface 110 where the balance weight 130 is provided, or that the circumferential surface 110 of the drum 100 should be fabricated relatively thick.

Figure 3:
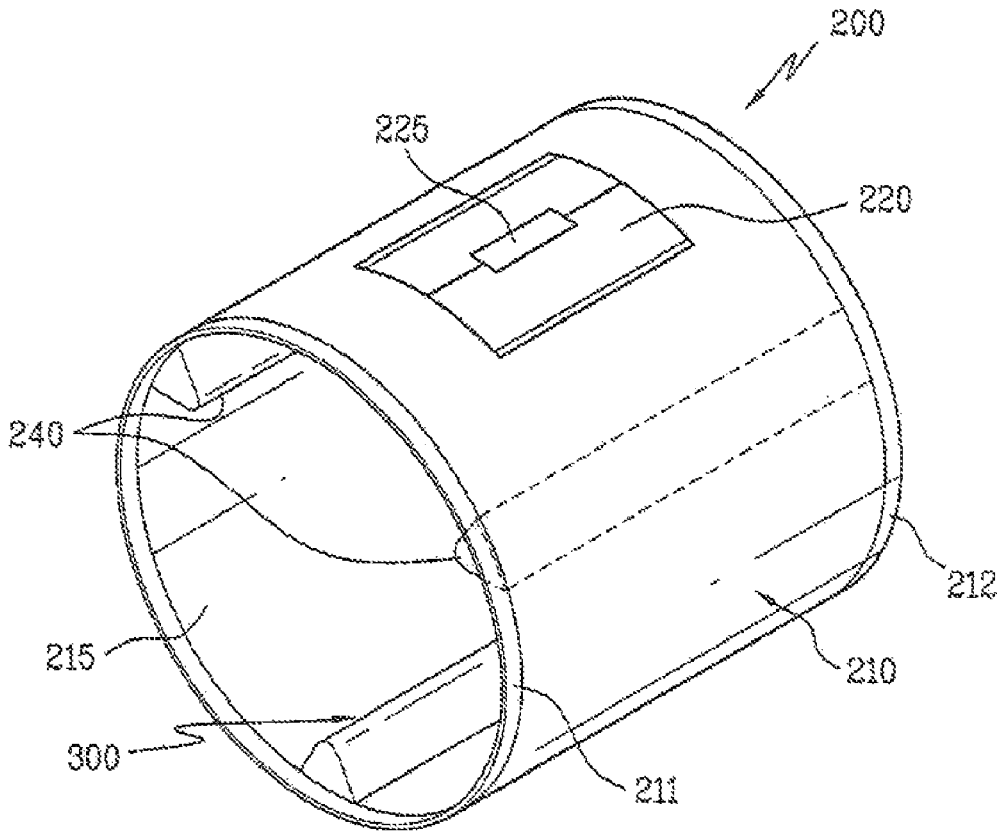
FIG. 3 is a perspective view illustrating a drum according to a second embodiment.
Figure 4:
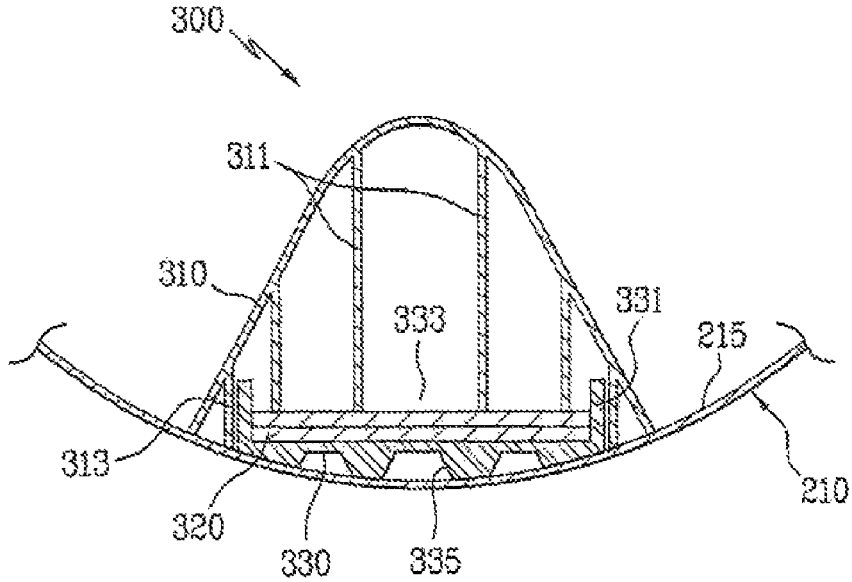
FIG. 4 is a sectional view schematically illustrating that a balance weight shown in FIG. 2 is secured to the drum.
Figure 5:
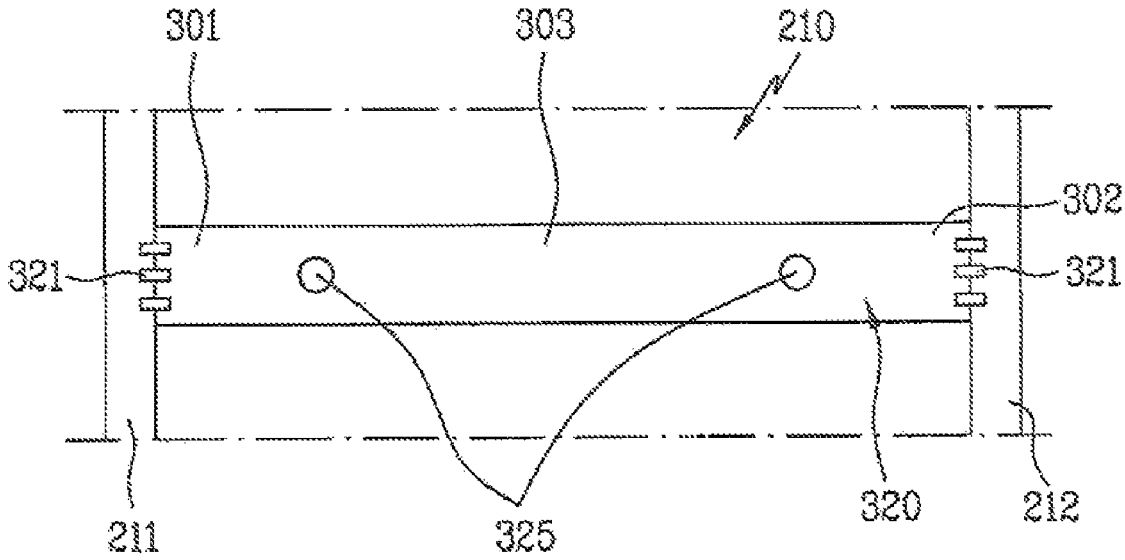
FIG. 5 is a plane view schematically illustrating that a balance weight shown in FIG. 2 is secured to the drum.

Accordingly, a second embodiment solves the above disadvantage and the second embodiment will be explained in detail as follows in reference to FIGS. 3 to 5. FIG. 3 illustrates a drum according to the second embodiment. FIG. 4 is a sectional view schematically illustrating that a balance weight shown in FIG. 2 is secured to the drum. FIG. 5 is a plane view illustrating that the balance weight shown in FIG. 2 is secured to the drum.

As shown in FIGS. 3 to 5, according to the second embodiment, an operable drum door 220 is provided at a circumferential surface 210 of the drum 200. The operable drum door 220 closes an opening formed in the circumferential surface 210 and may be licked by a latch 225. To reinforce the strength of the drum 200, rims 211 and 212 are formed at both ends of the circumferential surface 210, respectively. This structure is the same as described in the first embodiment and thus the detailed explanation will be omitted. Next, a balance weight 300 of the second embodiment will be explained, which is different from the balance weight 130 of the first embodiment.

As shown in FIG. 3, the balance weight 300 is provided opposite to the operable drum door 220 and it keeps balance of the drum 200 while the drum 200 is rotating. The gravity center of the drum 220 might be far off from the rotation center of the drum 200 during the rotation of the drum 120 because of the drum door 220. At this time, the balance weight 300 makes the gravity center of the drum 200 approach or substantially accord to the rotation center of the drum, and thus the balance of the drum 200 may be kept during the rotation of the drum.

As shown in FIG. 5, both longitudinally opposite ends of the balance weight 300 are secured to the rims 211 and 212, respectively. More specifically, a first end 301 of the balance weight 300 is secured to a first rim 211. A second end 302 of the balance weight 300 which is opposite to the first end 301 is secured to a second rim 212 which is opposite to the first rim 211. Here, the first end 301 and the second end 302 may be welded or brazed at the first rim 211 and the second rim 212 and alternatively may be secured by a securing member 321.

As shown in FIG. 5, the balance weight 300 includes a middle portion 303 provided between the first end 301 and the second end 302. The middle portion 303 of the balance weight 300 may be secured to the circumferential surface 210 of the drum 200 by fastening members 325. The balance weight 300 may be secured to the drum 200 by fastening members such as screws, bolts and revets or the like, or the balance weight 300 may be welded or brazed to the drum 200.

In the second embodiment, the ends of the balance weight 300 are secured to the rims 211 and 212 for reinforcing the ends of the drum 200, respectively. The circumferential surface 210 of the drum 200 according to the second embodiment does not have to be thicker to securely support the balance weight 300 and also reinforcement members do not have to be additionally attached to the drum 200. As a result, in the second embodiment, the structure of the drum 200 is simple and the balance weight 300 may be secured to the drum 200 solidly.

As shown in FIGS. 3 and 4, the balance weight 300 may be arranged on the inner circumferential surface 215. The balance weight 300 is projected from the inner circumferential surface 215 toward an inside of the drum. During the rotation of the drum, the balance weight 300 lifts and drops the laundry inside of the drum 200 to help washing or ringing.

As shown in FIG. 3, a plurality of lifters 240 may be provided on the inner circumferential surface 215 of the drum 200. The lifters 240 are projected from the inner circumferential surface 215. The lifters lift and drop the laundry inside the drum 200 to help washing and rinsing.

The balance weight 300 may have an appearance that is substantially identical to the plurality of lifters 240, such that the exterior beauty of the drum 200 may be enhanced. FIG. 2 illustrates that two lifters 240 and one balance weight 300 are provided on the drum 200. However, the number of the lifters and balance weights is not limited to the number of them shown in FIG. 3.

Alternatively, at least two balance weights 300 may be provided. If then, the balance weights 300 are arranged at a predetermined portion of the inner circumferential surface 215 to balance the drum 200, such that the gravity center of the drum 200 moved by the drum door 220 may substantially accord with the rotation center of the drum 200.

The balance weight 300, as shown in FIG. 4, may include a cover 310. The cover 310 is provided along a longitudinal direction of the drum 200. The cover 310 has an appearance that is substantially identical to the plurality of lifters 240. The cover 310 lifts and drops the laundry inside the drum 200, while the drum 200 is rotating.

The balance weight 300 may include only cover 310. In this case, the cover 310 should be relatively heavy. Alternatively, the balance weight 300 may further include at least one weight 320. At least one weight 320 may include at least one long plate or bar, for example. As shown in FIG. 4, the weights 320 may multi-layered in the cover 310.

If the weight 320 has this structure, a predetermined number of weights 320 corresponding to the weight of the drum door 220 may be arranged in the cover 310 in various kinds of models of washing machines or dryers. Thus, the balance weight 300 may be applicable to various models of washing machines or dryers.

As shown in FIG. 5, opposite ends of the weights 320 may be secured to the rims 211 and 212 of the drum 20, respectively. If necessary, the middle portion of at least one weight 320 may be secured to the circumferential surface 210 of the drum 200 by the securing members 325.

The cover 310, as shown in FIG. 4, may include at least one extension 311. The extension 311 is extended from the cover 310 to at least one weight 320 and it prevents at least one weight from playing. FIG. 4 illustrates that the extension 311 is extended from an inner surface of the cover 310 to an upper surface of the weight 320 to support both longitudinal ends and a middle portion of the weight 320.

The balance weight 300 may include a base 330. The base 330 is interposed between at least one weight 320 and the inner circumferential surface 215 of the drum 200 to securely support at least one weight 320. The base 300 is arranged on an inner circumferential surface 215 of the drum and the weights 320 may be multi-layered on the base 330.

The base 330 may include a curved bottom surface contacted to the inner circumferential surface 215. The curved bottom surface has an appearance substantially curved as much as the inner circumferential surface 215, such that an overall appearance is curved.

As shown in FIG. 4, the curved bottom surface of the base 330 may be uneven. The unevenness makes the weight of the base 330 relatively lighter and reinforces the strength of the base 330. For example, the evenness of the curved bottom surface may include a plurality of projections 335 and the projections 335 are projected from a bottom surface of the base 330 along a longitudinal direction of the base 330 to reinforce the strength of the base 330.

Also, the base 330 may include side walls 331 and the side walls 331 are upwardly extended from a top or sides of the base 330. Hence, the weights 320 multi-layered on the top surface may be accommodated in a space surrounded by the side walls 331, such that the side walls 331 prevent the weights 320 from playing in a horizontal direction. Alternatively, the base 330 may include a recess 333 formed in the top surface of the base 330 to accommodate the weights 320.

As shown in FIG. 4, the cover 310 may include at least one protrusion 313. The protrusions 313 are protruded downwardly from the cover 310 and support sides of the base 330, to prevent the base 330 from playing.

The balance weight having the above structure has an advantage of balancing of the drum during the rotation of the drum having the drum door provided in the circumferential surface. Also, the balance weight lifts and drops the laundry inside the drum, and thus there is another advantage that the balance weight helps washes and rinsing.

Moreover, the ends of the balance weight are secured to the rims, respectively, to reinforce the strength of the ends. There is a further advantage that the balance weight may be secured solidly to the drum. Also, additional members for securely supporting the balance weight may not be required nor may the drum be thick. As a result, there is a still further advantage that the structure of the drum can be simple.

The balance weight, for example, the cover has an appearance which is substantially identical to the lifters provided on the inner circumferential surface of the drum. Thus, there is a still further advantage that exterior beauty of the drum may be enhanced. Also, since the balance weight is installed on the position where the lifters are installed, space for the balance weight as well as for the lifters may be reduced. Fabrication cost and the number of parts may be also reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum for a washing machine or a dryer, the drum comprising:

an operable drum door provided at a circumferential surface of the drum;

a balance weight provided at the circumferential surface of the drum, wherein the balance weight is placed opposite to the operable drum door to balance the drum;

wherein the balance weight comprises:

a first end secured to a first rim of the drum; and a second end opposite to the first end, wherein the second end is secured to a second rim of the drum which is opposite to the first rim of the drum.

2. The drum as claimed in claim 1, wherein the balance weight further comprises a middle portion secured to the circumferential surface of the drum.

3. The drum as claimed in claim 1, wherein the balance weight is arranged on an inner circumferential surface of the drum so that the balance weight lifts and drops laundry inside the drum during rotation of the drum.

4. The drum as claimed in claim 1, further comprising a plurality of lifters provided on an inner circumferential surface of the drum to lift and drop laundry inside the drum during rotation of the drum, wherein the balance weight has an appearance substantially identical to the plurality of lifters.

5. The drum as claimed in claim 1, wherein the balance weight comprises a cover arranged along a longitudinal direction of the drum.

6. The drum as claimed in claim 5, wherein the balance weight further comprises at least one weight provided in the cover.

7. The drum as claimed in claim 6, wherein the cover comprises at least one extension extended from the cover to at least one weight to prevent at least one weight from playing.

8. The drum as claimed in claim 6, wherein the balance weight further comprises a base interposed between at least one weight and the drum to securely support at least one weight.

9. The drum as claimed in claim 8, wherein the base comprises a curved bottom surface that contacts with an inner surface of the drum.

10. The drum as claimed in claim 8, wherein the base comprises a plurality of projections projected from a surface of the base along a longitudinal direction of the base to reinforce the strength of the base.

11. The drum as claimed in claim 8, wherein the base comprises side walls upwardly extended from a top or sides of the base to accommodate at least one weight therein.

12. The drum as claimed in claim 8, wherein the base comprises a recess provided on a top of the base to accommodate at least one weight therein.

13. The drum as claimed in claim 8, wherein the cover comprises at least one protrusion protruded from the cover to prevent the base from playing.

* * * * *